US006938900B2

(12) United States Patent
Snow

(10) Patent No.: US 6,938,900 B2
(45) Date of Patent: Sep. 6, 2005

(54) METHOD OF PLAYING A POKER-TYPE WAGERING GAME WITH MULTIPLE BETTING OPTIONS

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 10/293,044

(22) Filed: Nov. 12, 2002

(65) Prior Publication Data

US 2004/0090005 A1 May 13, 2004

(51) Int. Cl.[7] ..... A63F 1/00
(52) U.S. Cl. ..... 273/292; 273/274; 273/309
(58) Field of Search ..... 273/292, 274, 273/309; 463/12, 13

(56) References Cited

U.S. PATENT DOCUMENTS

| | | | | |
|---|---|---|---|---|
| 5,167,413 | A | 12/1992 | Fulton | |
| 5,251,897 | A | 10/1993 | Fulton | |
| 5,411,257 | A | 5/1995 | Fulton | |
| 5,417,430 | A * | 5/1995 | Breeding | 273/292 |
| 5,615,888 | A | 4/1997 | Lofink et al. | |
| 5,660,392 | A | 8/1997 | Hansen | |
| 5,820,460 | A | 10/1998 | Fulton | |
| 5,839,730 | A | 11/1998 | Pike | |
| 5,921,550 | A | 7/1999 | Awada | |
| 5,988,643 | A | 11/1999 | Awada | |
| 6,604,741 | B1 | 8/2003 | Snow | |
| 6,637,746 | B1 * | 10/2003 | Baranauskas | 273/292 |
| 2002/0137558 | A1 * | 9/2002 | Hartl | 463/11 |
| 2003/0022709 | A1 * | 1/2003 | Awada | 463/12 |

OTHER PUBLICATIONS

"Banking Card Games", Chapter 16, Blackjack, Scame's Encyclopedia of Card Games, by John Scame, 1973, pp. 279–288.

Over/Under 13 Blackjack by Gaming Concepts, Inc., 1988.

* cited by examiner

*Primary Examiner*—Benjamin Layno
(74) *Attorney, Agent, or Firm*—Mark A. Litman & Assoc. PA.

(57) ABSTRACT

A method of playing a wagering card game for a number of player using standard playing cards having a standard rank and involving standard poker hand rankings comprises: each player placing at least four distinct wagering parts to participate in the game; dealing three cards to each player and at least two common cards, all of the at least two common cards being dealt face down; giving each player the chance to examine the cards received by that player and to withdraw at least a first part of the at least four distinct wagering parts wager based on the rank of the player's cards prior to one of the at least two common cards being dealt face down being exposed; showing the at least one common card, thereby providing at least a partial hand for each player, each player's at least a partial hand comprising the shown at least one common card and the cards each player was dealt; allowing each player to withdraw a second part of the at least four wagering parts and forfeiting a third part of the at least four wagering parts; showing at least one more common card to expose all common cards that had been dealt face down; and resolving each player's remaining wager based on the rank of that player's hand, which remaining wager was not withdrawn.

59 Claims, 2 Drawing Sheets

METHOD OF PLAYING A POKER-TYPE WAGERING GAME WITH MULTIPLE BETTING OPTIONS

BACKGROUND OF THE INVENTION

1. Field of the Invention

The present invention relates to playing card wagering games that can be played with playing cards, including a standard deck of cards or by video machine technology in a casino or home environment. In particular, it relates to a method and apparatus for playing a wagering game, wherein the game is a variation of five card stud poker and provides players the opportunity to take or leave a portion of their wager during the course of the game.

2. Background of the Art

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

U.S. Pat. No. 5,288,081 (Breeding) describes the game Let It Ride® stud poker which is played in many casinos around the world. That wagering game is played with a single, typical (standard) fifty-two card poker deck and broadly involves the generally well recognized and accepted set of rules, procedures and wager-resolving outcomes of five card poker. The game method comprises each player placing an initial, three-part wager (all bet parts are equal) to participate in the game. A separate bonus wager (a side bet wager) may be placed to play against a pay table. Cards are dealt by a dealer, three down to each player and two down to the dealer. Players inspect or "sweat" their cards, and the dealer asks "take it or leave it?" or as the name of the game implies, "Let It Ride®?" with regard to the first part of the initial bet. Players can choose to retrieve or remove from play the first part of their initial bet, or leave the first part in play or at risk, based on the value of the three cards in their hand. The side wager or bonus wager cannot be withdrawn and is immediately withdrawn by the house in the play of the game. The dealer then turns over one of the dealer's cards and the dealer's query is repeated with regard to the second part of the initial bet. Players can choose to retrieve or remove from play the second part of their initial bet or leave the second part in play or at risk, based on the value of the four cards consisting of the three cards in the player's hand and the exposed dealer's card. Players have no option with the third part of the bet. Finally, all cards are shown and the payouts and collections are resolved according to the ranking of the poker hand of each player, i.e., the players are not playing against each other or the dealer.

Another element of play in casino games and particularly casino table card games in the wagering structure. There are a multitude of card games that are based on one or more decks of conventional playing cards. Among the most popular of these games is poker, wherein a player's fortunes are determined by a well-known hierarchy of card combinations. Card games that are variants of poker are also very popular, such as Let It Ride® stud poker, Caribbean Stud® poker, Three Card Poker® and the like. This is due, at least in part, to the basic nature of the underlying game itself, combining elements of both strategy and luck. Additionally, poker-variants allow an existing player-base to capitalize on their preexisting knowledge of a game and to apply that knowledge in novel settings. The two most popular forms of traditional poker are draw poker and stud poker.

In a conventional hand of draw poker, a single 52-card deck of shuffled playing cards is used. Each player begins a hand by contributing an initial or "ante" bet to a common pool or "pot", the pot ultimately going to the owner of the single winning hand. The dealer then distributes five face-down cards to each player, the remaining cards in the deck being set aside for later use. Each player evaluates the cards that he or she has been dealt and each, in turn, is given an opportunity to discard one or more cards from the dealt hand. The dealer gives the player replacement cards for those that have been discarded by dealing additional cards face-down from the top of the deck. Following the deal, one or more rounds of betting take place, during which time each player may make an initial raise, a check wager, fold (drop-out), match a previous raise or raise a previous bet. These wagers are all added to the pot. The meanings of these wagering terms are well known to those skilled in the art and typical definitions of same may be found in, for example, *Hoyle's Rules of Games,* pp. 75–102, by Morehead and Mot-Smith, 1963, the disclosure of which is incorporated herein by reference. At the conclusion of the wagering rounds, the players display their hands and the holder of the highest ranking poker hand takes all of the money in the pot.

Stud poker is the most popular form of "open poker," wherein each player is dealt some cards that are face-up and, hence, available for viewing by the other players. Stud poker comes in two varieties: 5-card and 7-card, the two being of approximately equal popularity. In five-card stud poker, the dealer gives each player a face-down (or "hole" card) and then a face-up card. Thus, at the start each player knows his own two cards and one card of each of his opponents. After the first two cards are dealt, a wagering round ensues, during which time each player contributes his or her wager to the pot. A typical description of the rules that govern this round might be found in, for example, Hoyle's Rules of Games, pp. 75–102, by Morehead and Mot-Smith, 1963, the disclosure of which is incorporated herein by reference. After the wagering round, another card is dealt face-up to each player. This is followed by another wagering round. Alternating dealing and wagering rounds continue until each player has a total of five cards: four face-up and a concealed hole card. After the final bets have been placed, each player who has not dropped out during the deal/wager rounds reveals his or her hole card. The owner of the highest ranking 5-card poker hand wins and takes whatever amount is in the pot. Only the player with the highest ranking hand wins.

Seven-card stud poker differs slightly from 5-card poker. First, in 7-card poker each player initially receives two cards face-down and one card face-up. A bidding round then ensues. The dealer then gives each player another face-up card, which is followed again by a bidding round. Deals (of one face-up card) and bids are alternated until each player has four face-up cards and two face-down cards. Finally, a third face-down card is dealt to each player (making a total of seven cards). This is followed by a last bidding round. The winner of the hand is the player who can form the highest ranking 5-card poker hand from his seven cards.

As is well known to those skilled in the art, five-card poker hands are ranked from "Royal Flush" (highest) to "High Card(s) in Hand" (lowest) according to the following ordering:

| Hand | Description | Example |
|---|---|---|
| Royal Flush | The five top cards of a suit | A, K, Q, J, 10 (suited) |
| Straight Flush | Five cards in sequence in the same suit | 5, 6, 7, 8, 9 (suited) |
| Four of a Kind | Any four cards of the same rank | 2, 2, 2, 2, J |
| Full House | Three of a kind and a pair | 2, 2, 2, J, J |
| Flush | Five cards of the same suit | 2, 4, 8, 10, A (suited) |
| Straight | Five cards in sequence | 6, 7, 8, 9, 10 (unsuited) |
| Three of a Kind | Three cards of the same rank | 2, 2, 2, 9, J |
| Two Pair | Two cards of the same rank and two others of a different rank | 2, 2, Q, Q, A (unsuited) |
| One Pair | Two cards of the same rank | 9, 9, 5, 8, K |
| High Card(s) in Hand | Five unmatched cards | A, 9, 5, 3, 2, (unsuited) |

In some variations of poker, the ace may also act as the lowest card in the deck to form a straight when used in a sequence like A, 2, 3, 4. Additionally, a "wild card"—often the "joker" card may be designated, so that a person who holds that card may declare its value to be that of any card in the deck, the presumption being that the declared card value will help that player form a better poker hand.

At its core, poker is a vehicle for gambling. Commonly the quantities wagered are monetary, but that is not strictly required and poker chips, matches, and other non-pecuniary tokens have been used in place of money to help the players determine who is winning without exposing them to financial loss. Of course, casinos are in the business of providing people with the opportunity to gamble and, given the popularity of poker among the general populous, it only stands to reason that casinos would desire to offer this game in some form or another to those who seek to play it. However, conventional-rules poker is not particularly well suited for use in a casino.

A casino that offers traditional poker to its clientele typically does so by providing a dealer and a room in which to play, but the casino's dealer does not actually participate in the game as a player. His or her function is just to distribute the cards and referee the game. The casino makes its money by taking some percent of all of the money wagered (the "rake") or by leasing the room to the participants. The cost of the lease may be measured in time (e.g., a fixed amount per hour) or by a count of the number of hands played. Traditional poker games are not particularly favored by casinos because the casino does not make as much money acting as a landlord as it would if it were an active participant in the game. Similarly, from the standpoint of the gaming public, traditional poker has some disadvantages which have tended to make it less desirable as a casino game. First, traditional poker is readily available "at home," e.g., at the Friday night poker session, and there is no particular need for most people to travel to a casino to play it. Second, when an individual wins at traditional poker it is at the expense of the other players/participants. Many people prefer to play against the more impersonal "house" (i.e., the casino) so that their winning hand does not necessarily result in a loss by a fellow player, who may be an acquaintance. Finally, traditional poker does not offer the excitement associated with "jackpot" type games. That is, a royal flush in traditional poker—as improbable as that card combination is—will result in winning only the amount in the pot and nothing more. Many players seek out games where there is some possibility of "winning big," an option that is not available under conventional poker rules.

As a consequence of these disadvantages, casinos have introduced a variety of poker-type game variants to address the shortcomings discussed previously. One obvious advantage of these poker-type games from the casino's point of view is that the casino becomes an active participant in the game (as the house) and can, as a consequence, increase the revenue earned with the game. Additionally, these poker-type games are very attractive to many of the gambling public, and the mere fact that they are available in a particular casino has the potential to increase consumer traffic and revenue there.

A variety of innovative strategies have been employed to make poker-type games more appealing to casino gamblers. For example, many poker-variants are designed to let the players compete against the house, rather than against each other. In other cases, progressive betting has been utilized, wherein the player may increase his or her bet during the play of a hand. This makes the game more exciting to the player and potentially more profitable for the casino. Jackpots have been introduced, wherein certain card combinations in the player's hand result in an enhanced payout to that player. Finally, computer implementations of these games is always an attractive possibility, with video based casino games becoming increasingly popular. One such video implementation of a poker-type game is taught by Weingardt, U.S. Pat. No. 5,042,818. Of course, a natural next step is to offer these same video based casino games over the Internet, thereby making the games available to a potentially enormous audience. The most successful casino table poker games to date are Let It Ride® stud poker (as originally described in U.S. Pat. No. 5,288,081), Caribbean Stud Poker® (originally described in U.S. Pat. No. 4,836,533), and Three Card Poker® (as described in U.S. Pat. No. 6,237,916).

In most casinos, a game of blackjack begins by having each player place an initial wager. The blackjack dealer then distributes two cards face-down to each player and two cards—one face up and another face down—to him or herself. After the player has examined the two dealt cards and compared those cards with the face-up dealer's card, a number of options present themselves to the player. The player may "stand" (i.e., take no further cards), draw one or more additional cards in order to increase the numeric sum of the hand, double down (a form of progressive wagering), or split the two cards.

Additionally, if the dealer's face-up card is an ace, the player may elect to buy insurance against the possibility that the dealer has a blackjack. If, after the dealer's face-down card is revealed, the dealer does not have a blackjack, the player loses the amount that was paid as insurance (although he or she may go on to ultimately win that deal). If, on the other hand, the dealer has a blackjack, the player collects double the amount of insurance bought (but may still lose the amount of the original wager). The option of purchasing insurance is unique to blackjack type games and has not, heretofore, been available in poker-style games. The broad rules of blackjack are generally known to those skilled in the art and a fuller description may be found in the materials previously incorporated by reference.

In addition to novel games being introduced into casinos, novel betting formats have also been introduced. Side bets have always been common in wagering environments, but the use of side bets for jackpots and bonuses in casino table card games was believed to have been first practiced by David Sklansky in about 1982 in a public showing of Sklansky's Poker in Las Vegas, Nev. The play and/or betting structure of Caribbean Stud Poker® was modeled after that game. Blackjack has allowed surrender play at many tables, where half the original wager is withdrawn and the other half is forfeited to the house at the election of the player. U.S. Pat. No. 5,820,460 (Fulton) describes a method for playing a casino table card game wherein wagers are changed after some cards are viewed by the player. Let It Ride® stud poker advanced that theory significantly as described in U.S. Pat. No. 6,273,424, where specific segments of wagers could be withdrawn from an original wager that was made in multiple parts.

It is still beneficial to provide additional wagering formats and structures to add both interest to the game and better control over house retention and player awards.

The desired attributes of wagering games outlined above are in large measure provided by the method and apparatus for a wagering game in accordance with the present invention. The game is uncomplicated, exciting and provides the opportunity for players to make multiple wagers and choices regarding those wagers.

SUMMARY OF THE INVENTION

The wagering game of the present invention is played with a single, typical fifty-two card poker deck and broadly involves the generally well recognized and accepted set of rules, procedures and wager-resolving outcomes of five card poker. One embodiment of the game is a variation of Let it Ride® Stud Poker, as described in my co-pending application Ser. No. 10/286,440 filed Oct. 31, 2002 and Ser. No. 10/254,628 filed Sep. 24, 2002, both entitled Bet Withdrawal Casino Game With Wild Symbol, the content of both specifications hereby incorporated by reference.

The game method of the present invention comprises each player placing an initial, three or more part wager, and preferably a four-part wager (as opposed to the required three-part wager used in Let It Ride® stud poker) to participate in the game. Cards are dealt by a dealer. In one example, three cards are dealt face down to each player and two cards are dealt face down to the dealer. Players inspect or "sweat" their cards, and the dealer asks "take it or leave it?" or "Let It Ride®?" with regard to the first part of the initial bet. Players can choose to retrieve or remove from play the first part of their initial bet, or leave the first part in play or at risk, based on the value of the three cards in their hand. The dealer then turns over one of the dealer's cards and that card is considered a part of each player's hand. The dealer's query is repeated with regard to the second and third parts of the initial bet, except that withdrawal of the second part of the bet results in the house automatically claiming the third part of the wager. This step requires that two parts (the second part and the third part) of the four-part bets (usually equal parts) be considered at the same time of play. This interdependency between the second and third bets could alternatively exist between the first and second bets. Players can choose to retrieve or remove from play the second part and forfeit the third part of their initial bet or leave the second part and third part in play or at risk, based on the value of the four cards consisting of the three cards in the player's hand and the first exposed dealer's card. Players have no option with the fourth part of the bet, which is referred to as the contract wager, as it must remain in play through the conclusion of play of the game. Finally, all cards are shown and the payouts and collections are resolved according to the ranking of the poker hand of each player, i.e., the players are not playing against each other or the dealer.

Several variations in the game are contemplated by the present invention. For example, three wagers rather than four may be placed. The player has the option to withdraw his first bet. If he withdraws the first bet, the second bet is swept by the house. The third bet is the contract bet and cannot be removed by the player. Similarly, the player could place five bets, with the second and third, or third and fourth bets having the interdependency of that of the second and third bets in the first example of the invention. What is meant by "interdependency" for purposes of this disclosure is that when any bet, except the contract bet is withdrawn by the player, another bet is automatically forfeited to the house.

The game play could be similarly modified, allowing the players and dealer more or less cards. What is important to the invention is that the player receive partial information about his hand, and then be given at least one opportunity to withdraw a portion of his bet, resulting in an automatic forfeiture of another portion of this bet as a result of the decision to withdraw.

The pay table in this game (to be marketed as "Dakota Stud™" table card game) can be adjusted from the pay tables in Let It Ride® poker to reflect the change in betting/wagering structure. For example, to compensate for the required forfeit of the third wager part if the second wager part is withdrawn, the qualifying hand for a win may be lowered from the pair of 10's ordinarily required to win against the pay table in Let It Ride® stud poker. For example, the minimum winning hand may be any pair, a pair of 2's, 3's, 4's, 5's, 6's, 7's, 8's or 9's. Additionally, higher odds may be paid on higher ranked hands to make play of the game more attractive to players. The game may also be modified to provide the player with five cards and the dealer with two hole cards or common cards, with the best five-card poker hand playing against a pay table, or with the player being dealt four cards, and the dealer receiving three cards. This may be done with the dealer having one of the three cards exposed immediately before consideration of withdrawal of the first part of the wager, or with three cards provided face down. In the latter circumstance, the dealer's face down cards may be exposed one-at-a-time, or preferably two at one time and one card at another time in the betting/wagering sequence. Two cards may be exposed before consideration of withdrawal of the second (and third) parts of the wager, or first one card exposed at this stage and then two cards exposed at the end of play, after withdrawal of the second and third parts has been considered and exercised.

More specifically, in the preferred play of the game, the initial wager placed by each player comprises four equal parts and is made or placed before any cards are dealt. Each player is dealt three cards face down in the customary fashion. Two common cards are dealt face down in front of the dealer for use by all of the players. Each player will use the two common cards in front of the dealer in combination with his or her three cards to create a five-card hand. After all players have placed their four wagers/bets (and in an optional play of the game, a special bonus wager or jackpot wager for extra or extraordinary awards for high ranking hands against a pay table) and received and examined their cards, each is given the opportunity to retrieve one part (if equal wagers are placed, that is one-fourth) of the initial wager before the dealer reveals one of the two down cards previously placed in front of him. After all of the players have been queried and decided whether to withdraw the first part of their wager, the dealer turns one of the down cards face up. Each player now has the benefit of four cards, the three he or she is holding down plus the common card, and the dealer again gives each player the opportunity to retrieve further part(s) of the initial wager. In this case, with equal wagers, the player has the option of leaving the second and third parts in play or withdrawing the second part and forfeiting the third part before exposing the second common down card. After the second common down card is revealed, the players turn up the three cards they are holding thereby forming five card hands made up of the three cards dealt to each player and the two dealer cards. The dealer examines each of the players hands and determines what payout, if any, each player is entitled to receive according to that players' remaining wager and a preselected payout schedule. Payouts are made to players with winning hands and the losing wagers are collected. The cards are then reshuffled for the next hand. Where a separate side bet has been placed as a bonus or jackpot wager (against a pay table and/or against a progressive jackpot), that wager must also be resolved.

Apparatus is disclosed for playing the wagering game according to the method outlined above. A typical gaming table, with a playing surface, is modified to include specific areas that provide locations for placing the wagers and for displaying the common cards. A card shuffling machine such as that disclosed in U.S. Pat. No. 4,807,884 or other shuffling machines manufactured by Shuffle Master Gaming, Inc. of Las Vegas, Nev. for facilitating and speeding the play of the wagering game may be used. A display device may be associated with the apparatus for displaying game information, shuffle status, or other information relevant to the dealer, the players or the house.

The present invention provides an exciting and interesting wagering game. The wagering game is easy to learn, largely being based on five-card stud poker and the well known ranking of five card poker hands. The present invention provides a new variation of a well known wagering game, five card poker, and in particular Let It Ride® stud poker, which is made more interesting by providing the opportunity for players to make multiple wagers and decisions related to those wagers based on the progress of the game.

Still another aspect of the present invention is to provide a wagering game that is easy to learn, yet demands skill of players in making strategic decisions about whether to withdraw a portion of the bet. It is yet another aspect of the present invention to provide a unique, exciting card game for play in casinos or at home and on various media including casino tables, video poker machines, video lottery terminals or home computers. It is an advantage of the game of the present invention that wagering decisions are inherent in the game. The game enhances players' sense of participation and takes advantage of players' inclination to keep wagers at risk once placed. The interdependency of at least two bets further encourages players to let bets remain at risk.

DETAILED DESCRIPTION OF THE INVENTION

Figure 1:
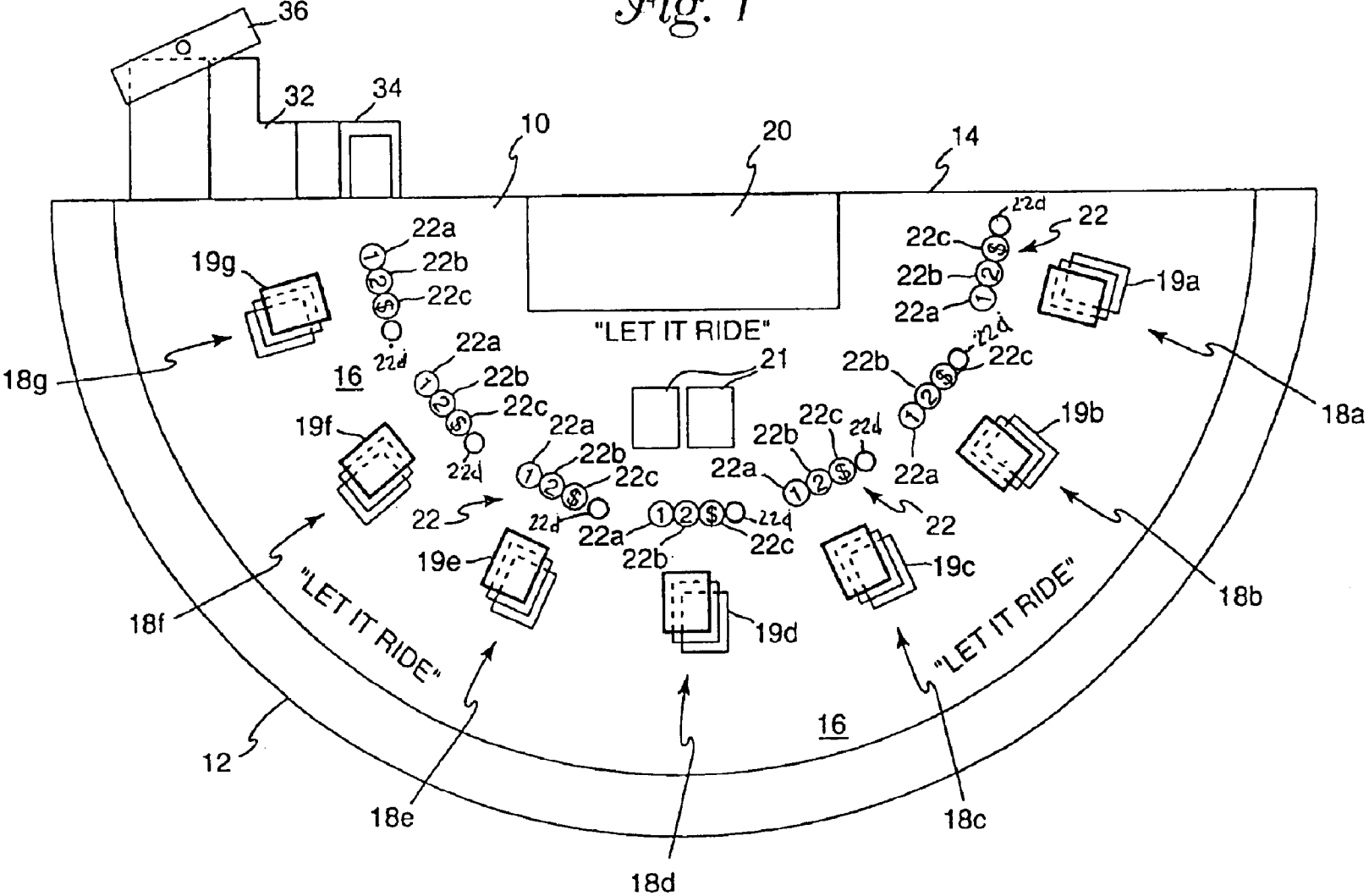
FIG. 1 depicts the table layout and apparatus used in playing the wagering game of the present invention.

Referring to FIG. 1, the apparatus for the wagering game of the present invention includes a typical casino gambling or gaming table 10. The table 10 has a curved side 12 for accommodating up to seven players and a straight side 14 for accommodating the dealer. The table 10 has a flat surface 16 covered with felt or other appropriate material. Although seven playing positions or locations 18*a–g* for individual players are provided, it is not essential to the game that exactly seven persons play and as many as sixteen players may participate. For casino play, a maximum of seven players provides for a game that is easily manageable by the dealer and house, and one in which the individual players feel more involved. A house dealer position 20, including an area suitable for displaying the dealer's cards 21, is provided.

Each of the playing positions 18*a–g* includes a wagering zone 22, comprising four separate and distinct wagering or betting areas 22*a, b, c, d*. A separate wagering area 22*e* may be provided for placing of a bonus, jackpot (e.g., progressive jackpot) or other type of side bet wager. Each position 118*a–g* also includes a card area 19*a–g* for receiving and displaying cards dealt to the player occupying the position. The wagering areas 22*a, b, c, d* are designed to receive appropriate wagering indicators or settling means such as chips or markers (not shown).

At one side of the dealer station 20, the apparatus for practicing the method of the present invention may include a microprocessor or computer controlled shuffling machine 32 supported by a table extension 34. The shuffling machine 32 may be of the type disclosed in U.S. Pat. No. 4,807,884, U.S. Pat. No. 6,149,154 (both assigned to Shuffle Master, Inc.) or any other single deck or multideck shuffling apparatus manufactured by Shuffle Master Gaming, Inc., the disclosure of which patent is incorporated herein by reference. The shuffling machine 32 may include a dealing module for automatically and sequentially dealing cards and also may include a display means for displaying wager amounts, the identity of winning players, or other game related information.

Figure 2:
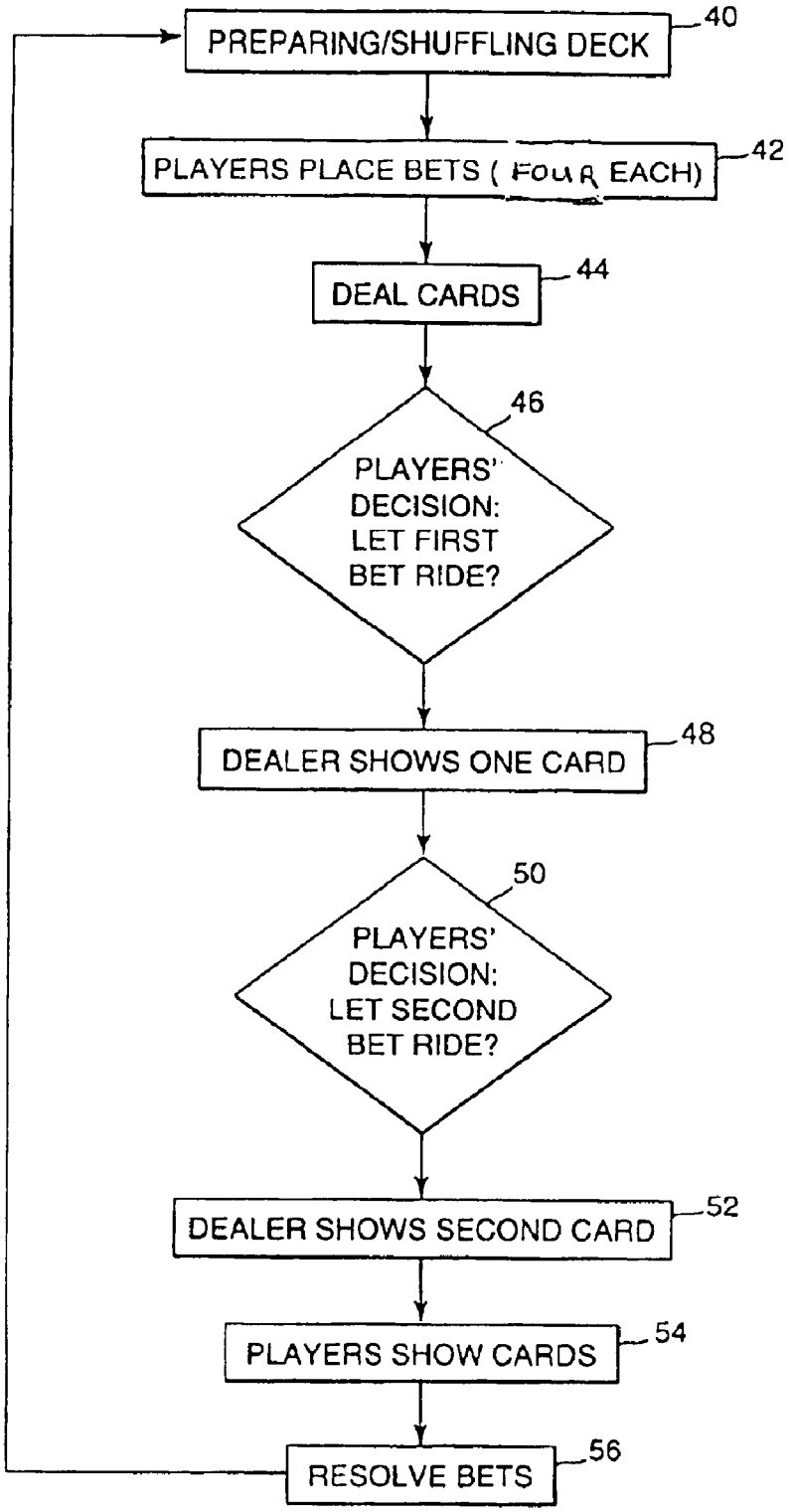
FIG. 2 is a block diagram representing the flow of play in the game.

Referring to the flow diagram of FIG. 2, the initial step in playing the game of the present invention is preparing or shuffling a deck of cards, represented at block 40, by activating the shuffling machine 32 or by hand-shuffling a deck to provide a shuffled deck. Typically, a standard 52 card deck with four different suits is used. Next, the players place the initial wager, block 42, by putting equal amounts in each of the four betting areas 22*a, b, c, d*. Two of the parts of this initial wager, the parts placed in wagering area 22*a* and 22*b* are retrievable at the option of the player. The third portion placed in area 22*c* is a wager that is forfeited if the second wager at 22*b* is withdrawn or stays at risk if the second portion remains at risk. The fourth part 22*d* of the four part wager is a non-withdrawable bet. After the placing of the wager by each player, the cards are dealt, block 44, preferably three cards being dealt down to each player and preferably two cards are dealt down in front of the dealer. The players inspect or "sweat" their cards in preparation for reaching decision block 46. At decision block 46, the players are queried by the dealer about whether the first part of the initial wager, the part placed in wagering area 22*a*, should be left or whether the player wishes to withdraw that portion of the bet. Each player makes the decision at decision block 46 on the basis of the three cards forming the player's incomplete hand at this point. Once each player has been queried and has decided whether or not to let the first portion of the bet ride, and those bets the player chooses to retrieve or remove are physically removed from area 22*a* and returned to the player, the dealer shows one of the down common cards, block 48. Now, each player has four cards to consider, the three cards dealt to that player originally and the single common card showing on the table. Each player must then decide whether to let the second part of the initial wager ride or whether to withdraw it from the game. As noted, if the second part of the wager is withdrawn, the third part of the wager is forfeited and is collected by the house. After each player is queried and decides what to do with regard to the second part of the bet, and those bets to be withdrawn are physically removed from area 22*b* and returned to the player, the dealer reveals the second common down card, as represented at block 52. Each player now has a five-card hand comprised of the three cards each player was originally dealt plus the two revealed common cards. The fourth bet, the bet placed at wagering area 22*d*, is a nonretrievable portion of the initial bet and the flow of the game proceeds to block 54 wherein the players show or reveal their three cards to the dealer. The dealer resolves each player's bet (which includes all four parts, the second, third and fourth part or only the fourth part, or the first and fourth part, depending on the player's choices during play of the hand) based on the five card hand at block 56 and determines what payout, if any, the player is entitled to receive according to the payout schedule at the particular gaming table or casino. Bets on non-winning hands are collected by the dealer or house. The hand is then over and the flow of the game returns to block 40, preparing and shuffling the deck for a new hand.

The award or payoff is given for each of the optional bets that remain at risk at the end of the hand and for the nonwithdrawable part of the bet. A typical pay table would be as follows:

| | |
|---|---|
| Pair, Sixes or Better | 1-1 (even money) |
| Two Pairs | 2-1 |
| Three of a Kind | 3-1 |
| Straight | 4-1 |
| Flush | 6-1 |
| Full House | 9-1 |
| Four of a Kind | 40-1 |
| Straight Flush | 100-1 |
| Royal Flush | 500-1 |

The method of the present invention is not limited to five card poker games, but may be applied or used in other appropriate games such as seven card poker, as described elsewhere herein. The method of the present invention does not require a shuffling machine 32, dealing module 33 or a display means 36. However, these facilitate and expedite the play of the game as well as add interest to the game. While the initial wager of the present invention is preferably comprised of four equal bets, the bets do not necessarily have to be equal. The interdependent bets, such as the second and third parts in the above example, should be equal, or the third part may be smaller than or greater than the second part. Similarly, the first, second, third and fourth parts may be of different values, but the fourth bet must be at least equal to a table minimum and may be required to be at least equal to or greater than any other wager part. The method of the present invention could also include the placement of a contract bet, and two additional bets. When the player receives partial information on his hand (for example, three of five cards), he can withdraw the first part of his bet, and the house sweeps the second part of his bet. The hand is completed (for example, by revealing one or more common cards or dealing one or more extra cards to the player), and all bets that remain up are resolved. The betting structure of the present invention could also include making a five or more part bet, with one part being the contract bet and any of the two remaining bets being interdependent. It is preferable to mandate that the next to last bet be the bet that the house can take back in the event any previously placed bet is taken back by the player. This methodology encourages players to keep their bets in play. For example, the player may place six equal bets in a seven card stud game. The player is dealt three cards and the dealer is dealt four cards, face down. The player can withdraw a first bet after he views his first three cards. The dealer reveals a first common card and then has the opportunity to withdraw bet #2. The dealer reveals the second community card and the player can withdraw bet #3. The dealer reveals the third community card and the player can withdraw bet #4. If he does, the house sweeps bet #5. The $6^{th}$ bet, remains at risk. It is not necessary to require the player to keep subsequent bets at risk if he chooses not to withdraw a portion or portions of his bet. All betting decisions are preferably made independent of prior betting decisions in a given round of play.

The game can also be different. For example, the players could receive their own cards instead of playing with a combination of community cards.

Or, the base game could be 21, and the player can make up to six or more equal bets, one per card dealt. The player can withdraw a portion of his or her bet with each card played.

While equal bets are highly preferred for casino play, unequal bets may be offered in a casino or may be used in home play, if desired. The wagering game of the present invention might be played live in casinos with a dealer, or in casinos or homes in interactive electronic or video form with automatic coin or betting means receptacles and payout capability, wherein appropriate symbols for cards, wagers or score keeping would be displayed electronically. A "board-type game" suitable for home, club or casino use may also be provided for practicing the method of the present invention.

In combination with or separate from the play of Dakota Stud™ casino table poker, a new wagering structure resulting in different bonus structures may be used. The pure wagering structure described above, where the third part (or second part, in another example) of the wager is tied to the election made by the player on the separate part of the wager is itself novel. The use of that wagering structure in combination with certain pseudo-pooling payout outcomes at the table is a further advance in the structure of wagering and play at casino table card games.

An example of the additional wagering structure and alternative payout structures include the use of excess retention by the house because of the unique wagering structure described above in the four-part wager (e.g., retaining a pair of 10's or other rank higher than 6's, 7's, 8's, or 9's as the winning hand) or by providing the option of making a side bet to enter the additional award structure described below. Once the player is entered into the additional award structure (either automatically or with the optional or required side bet), the payout can be altered as follows. Those players that are entered into play of the additional award structure can participate in winning awards at the table, even where the awards occur in different hands, that is, hands of other players.

In present known table games with bonuses or jackpots with side wagers, only the player receiving the hand is paid on the achievement of the bonus hand of at least a predetermined rank. In some poker clubs, certain events are paid both to players at the table and to the winning player from a pool when certain unusual events occur. For example, house rake may be partially deposited in a pool account. When the event occurs, the pool is paid to the table where it occurs and the money in the pool is distributed proportionally. Such a situation would occur where, for example, the winning event in a pool was where a losing hand at a card table was at least a full house with at least three Aces and two 10's as the losing hand. The pool is distributed among the players and the sometimes the dealer at the table as, for example (70% to the winning hand, 10% to the losing hand and 20% to the remaining players at the table; or 70% to the winning hand, 15% to the second place hand, 20% to the remaining players at the table, and 5% to the dealer). The pool is a form of a progressive jackpot which is incremented according to discretionary rules of the poker club or casino. All players at the table share the pool winnings if they anted in the play of the hand where the winning event occurred. No distinct side wager or particular wagering element is required to enter into the chance to win the pool, which occurs with only a single specific event occurring, as described.

In the practice of the present invention, accruing a prize pool from the third (and/or other interdependent bet swept by the house) wager (automatically entering the player in the bonus event during the game) or preferably requiring a separate side wager to enter the bonus payout event is used to enable a player to enter the bonus event. The player is either required to place a side bet or has the option of placing a side bet to enter the bonus event. The bonus event is played against a pay table, whereby whenever any player at the table achieves a hand of predetermined rank, all players that are entered into the bonus event (either automatically or by placing the side bet) partakes of the bonus award for the predetermined hand. The rules may vary, so that a) only players that made the side bet wager can participate in the bonus, b) only players that made the side bet wager and remain in the game at the end of the hand can participate in the bonus, c) only players that made the side bet wager and have a qualifying hand can participate in the bonus, or d) only players that made the side bet wager and have a hand that beats the dealer's hand can participate in the bonus. The preferred method of play is a). Bonuses may be paid for only the highest hand, the top two hands, all winning hands or combinations thereof. The play of this bonus event with side bet can even be extended to include multiple tables. For example, certain progressive jackpot games link tables for the jackpot or bonus awards taken out of the jackpot pool. The tables can be linked by having players who had made the side bet wager at a distal table in the last hand before the bonus event was won at a proximal table. This is not a preferred embodiment (because of potential complexities in synchronization of play or debating when hands were played relative to distal side bets), but is within the skill of play and design. Additionally, the bonus may be paid either when any hand at the table achieves the predetermined hand rank, or only when a player that has made a side bet achieves a hand of the predetermined rank. The second format is preferred to stimulate more persons at the table to make the wager.

An aspect of this pay structure is to increase the frequency of bonus events at a table. With more players at a table, there are more hands per game at the table, and the hit frequency of bonus hands increases. Even though the actual size of individual awards per player decreases, the increased frequency improves the overall player acceptance of the game. For example, if there are six players at a table, the frequency of bonus hands statistically increases to six times what the frequency was with a single player at the table.

The payouts for each player will necessarily vary according to the number of players that are in the game and/or have made the side bonus bet. The various payouts on each hand vs. the number of players in one example is represented on the table layout as a matrix of payouts for the players and dealer to see. The house may require a minimum number of players to engage play of this side bet bonus event, primarily to limit the number of pay tables that must be displayed. It is also possible to have a display device (e.g., screen, monitor LED, liquid crystal display, plasma screen, etc.) that is fed by data from a computer or microprocessor or other image source to show the applicable or dynamic pay table for the number of players involved in the payout for the hands at any given point in time. For example, the display may show separate screen for 2 player, 3 player, 4 player, 5 player, 6 player and 7 player bonus events, each screen having different odds and payouts. Automated equipment indicating the number of wagers placed, the number of players entered, the rank of the hand, and other factors can be provided. For example, camera, scanners, digital readers, and software interpreting the data such as that provided in U.S. Pat. Nos. 6,313,871; 6,460,848; 6,126,166; 5,941,769; and the like could be used to assist in automating the reading of cards, ranks, wagers, and the number of players.

It is also possible for players to elect to play a "double bonus." In this format, rather than a typical one dollar side bet being placed, two separate one dollar wagers or a single two dollar wager may be placed to enter the player in both an individual bonus payout event and the shared bonus event discussed above. Except where the bonus was a progressive bonus, this system could be highly attractive to players. The rules must be clear in the event that a progressive jackpot is used, so that it would be understood that a 100% jackpot win by a player with both side bets placed would win 50% of the total jackpot for him/herself, and the remaining 50% would be split among players in the bonus event, including the winning player. With a fixed bonus pay table, one of five players at a table with both side bets having been placed (the individual bonus and the shared bonus or group bonus wager) would receive a payment of the fixed amount for obtaining a predetermined rank hand and approximately one-fifth of the award for the group award on the ranked hand. For example, if the ranked hand were a Straight Flush with a $2,000 fixed award, the player with that hand would win $2,400—$2,000 for the individual bonus side bet and $1/5^{th}$ of $2,000 ($400) for the group bonus wager.

The side bets may be made on sensing systems or by placing tokens, chips or money on the table that remain on the table at appropriate locations until conclusion of the game. Typical sensing devices include coin drops, photo optical sensors, proximity detectors, cameras, scales, and the like.

The format of this game is particularly compatible with any poker-type games where bonus awards are provided from a pay table, such as Let It Ride™ stud poker, Three CardPoker®, Crazy 4 Poker™, 3-5-7™ Poker table game, and the like. Pay table structures are particularly useful as multiple winning hand combinations combined with the "table bonus" feature dramatically increase the hit frequency of winning bonus events.

The method of the present invention is also useful in games where progressive jackpots are used, alone or in combination with pay tables, such as with certain formats of Caribbean Stud™ poker. The wager could also be used in games where there are special bonuses given to players who obtain unique hands. For example, in Pai Gow poker, there may be special awards for perfect Pai Gow hands (e.g., 9, 8, 7, 5, 4, 3 and 2) or uniquely ranked hands (e.g., a front pair of aces and at least four-of a-kind on the rear hand). The payouts could be made to all players participating in the wager (e.g., on a proportional basis), rather than just to the player who obtains the hand. The bonus wager could also be doubled so that a player could receive both the individual award and the group award for the hand.

The present invention may be embodied in other specific forms without departing from the essential attributes thereof. It is desired that the embodiments described above may be considered in all respects as illustrative, not restrictive, reference being made to the appended claims to indicate the scope of the invention.

What is claimed is:

1. A method of playing a wagering card game for a number of players using standard playing cards having a standard rank, said game involving standard poker hand rankings and comprising the steps of:

each player placing at least four distinct wagering parts to participate in the game;

dealing three cards to each player and at least two common cards, all of said at least two common cards being dealt face down;

giving each player the chance to examine the cards received by that player and to withdraw at least a first part of said at least four distinct wagering parts wager based on the rank of said player's cards prior to one of said at least two common cards being dealt face down being exposed;

showing said at least one common card, thereby providing at least a partial hand for each player, each player's at least a partial hand comprising said shown at least one common card and the cards each player was dealt;

allowing each player to withdraw a second part of the at least four wagering parts and forfeiting a third part of the at least four wagering parts to a house;

showing at least one more common card to expose all common cards that been dealt face dawn; and resolving each player's remaining wager based on the rank of that player's hand, which remaining wager was not withdrawn.

2. The method according to claim 1, said wager to participate in the game comprising exactly four parts.

3. The method according to claim 2, wherein there are exactly two common cards.

4. The method according to claim 3, wherein said four parts of said wager are equal.

5. The method of claim 3 wherein a side bet is placed by the player, prior to receiving and viewing player cards, to play against a bonus pay table and/or progressive jackpot.

6. The method according to claim 2, wherein said four parts of said wager are equal.

7. The method of claim 6 wherein a side bet is placed by the player, prior to receiving and viewing player cards, to play against a bonus pay table and/or progressive jackpot.

8. The method of claim 2 wherein a side bet is placed by the player, prior to receiving and viewing player cards, to play against a bonus pay table and/or progressive jackpot.

9. The method according to claim 1, wherein said wager is divided into four parts and the number of common cards is two.

10. The method of claim 9 wherein a side bet is placed by the player, prior to receiving and viewing player cards, to play against a bonus pay table and/or progressive jackpot.

11. The method according to claim 1, wherein said four parts of said wager are equal.

12. The method of claim 11 wherein a side bet is placed by the player, prior to receiving and viewing player cards, to play against a bonus pay table and/or progressive jackpot.

13. The method of claim 1 wherein a side bet is placed by the player, prior to receiving and viewing player cards, to play against a bonus pay table and/or progressive jackpot.

14. A method of playing a wagering card game for a number of players using standard playing cards baying a standard rank, said game involving standard poker hand rankings and comprising the steps of:

each player placing a wager of more than three parts to participate in the game;

a dealer dealing at least three cards face down to each player and at least two common cards face down;

giving each player the chance examine the at least three card received by that player and to withdraw a first part of said wager;

the dealer showing one of said common cards;

giving each player another chance to withdraw a second part of said wager and forfeiting a third part of said wager to a house;

showing a second of said at least two common cards to expose at least two common cards, thereby providing at least a five card band for each player, each player's playing a five card hand comprising the at least two showing common cards and the at least three cards each player was dealt; and resolving each player's remaining wager which was not withdrawn based on the ranking of that player's five card hand.

15. The method according to claim 14 wherein said wager is divided into four equal parts and wherein one of said parts may not be withdrawn.

16. The method according to claim 14 wherein the withdrawal of a second part of the wager requires forfeiture of only a third part of the wager.

17. A method of playing a wagering game with a single, standard fifty-two card poker deck, the cards having standard rank and value, said game involving generally well recognized and accepted five-card poker wager-resolving hand ranking outcomes and comprising the steps of:

each player wagering an initial, four-part wager amount to participate in the game;

a dealer dealing three cards face down to each participating player and two common cards face down for use by all participating players;

giving each participating player the chance to inspect the three cards that player received, the dealer then giving each player the choice of withdrawing or leaving at risk a first part of that player's initially wagered amount based on the rank and value of that player's three cards;

the dealer then turning over and showing one of the common cards and giving each player the choice of withdrawing or leaving at risk a second part of that player's initially wagered amount based on the rank and value of that player's three cards and the showing common card, wherein withdrawal of the second wager requires forfeiture of a third part of the wager to a house;

the dealer then turning over and showing the second common card and each participating player showing the three cards received from the dealer, thereby providing a five card hand for each participating player, each five card hand comprising the two showing common cards and the three cards each participating player was dealt; and resolving all remaining parts of the wager of each participating player's initially wagered amount which was not withdrawn, based on the poker hand ranking outcome of that player's five card hand.

18. The method according to claim 17 wherein the fourth part of the initially wagered amount must remain at risk.

19. The method according to claim 17 wherein the participating players are not playing against each other or against the dealer.

20. The method according to claim 17 wherein the initial four-part wager amount wagered by each participating player comprises four equal parts and is wagered before any cards are dealt.

21. The method according to claim 17 further comprising a step of providing apparatus for playing the wagering game; said apparatus including a playing surface having a wager-receiving area for receiving separately the four parts of participating players' initially wagered amount, a players' cards-receiving area for receiving and showing the three cards dealt to each participating player, and a common card-receiving area for receiving and showing the two common cards.

22. A method of playing a wagering game comprising a player placing a wager comprising at least three distinct wagering parts and providing to the player at least a portion of the player's game elements so that partial information or a game outcome is provided, giving the player at least one opportunity, before the player's final game outcome is determined, to withdraw from engagement in the game at least one wagering part of said at least three wagering parts, but less than all of said at least two wagering parts, wherein withdrawal of said at least one wagering part requires forfeiture of another wagering part and requires that one other wagering part of the at least three wagering parts remain in play to the end of the game; and continuing play of the game with additional portions of the player's game elements being displayed to the player.

23. The method of claim 22 wherein the at least three distinct wagering parts comprises four wagering parts.

24. The method of claim 23 wherein an optional bonus wager is offered to the player before any cards in the player's hand are seen.

25. The method of claim 22 wherein the at least three distinct wagering parts consists of four wagering parts in the wagering game.

26. The method of claim 25 wherein an optional bonus wager is offered to the player before any cards in the player's hand are seen.

27. The method of claim 22 wherein the at least three distinct wagering pails comprises four wagering parts, and it is withdrawal of the second part that requires forfeiture of the third part and the fourth wagering part remains in play to the conclusion of the game.

28. The method of claim 27 wherein an optional bonus wager is offered to the player before any cards in the player's hand are seen.

29. The method of claim 22 wherein an optional bonus wager is offered to the player before any cards in the player's hand are seen.

30. A method of playing a wagering game with multiple betting options, the method including the steps of:

placing a wager comprising at least three parts in order to engage in play of the wagering game;

a dealer dealing a partial a hand of cards to each player who placed the wager;

after viewing the partial hand, each player optionally withdrawing at least one part of his bet based on the rank and/or suit of the portion of the hand;

each player receiving at least one additional card;

wherein at least one part of the bet remains up during play of the game, and at least one part of the bet is forfeited to the house when another part of the bet is optionally withdrawn by the player; and resolving each bet according to the rules of the wagering game.

31. The method of claim 30, wherein the wager consists of four parts, and the third wager is forfeited if the second wager is withdrawn.

32. The method of claim 30, wherein the wagering game is 5 card poker.

33. The method of claim 30, wherein each additional card received by the player is a community card.

34. The method of claim 33, wherein a total of three cards are dealt to form the partial hand, and two additional community cards are dealt.

35. The method of claim 30, wherein each part of the wager is equal in value.

36. The method of claim 30, wherein the wagering game is 5 card stud poker, and hands are resolved according to the rules of the game.

37. The method of claim 30, wherein at least two parts of the wager are interdependent.

38. The method of claim 30, wherein two parts of the wager are interdependent.

39. The method of claim 30, wherein the game is 7 card stud poker, and the player receives three cards in his partial hand, and four community cards.

40. The method of claim 30, wherein a wager of up to six parts is placed, and the game is blackjack.

41. The method of claim 40, wherein the player may withdraw a portion of his bet after viewing his first two cards.

42. The method of claim 41, wherein the player may withdraw a portion of his bet after viewing each additional hit card.

43. The method of claim 30, wherein at least two of the parts of the bet are unequal in value.

44. The method of claim 30, wherein the wager consists of four parts, and the second wager is forfeited if the first wager is withdrawn.

45. The method of claim 30, wherein the game is five card stud poker, and all wagers are resolved against a pay table setting forth payout odds for a hierarchy of predetermined card combination rankings.

46. The method of claim 30, wherein each additional card received by the player is a card specifically assigned to that player.

47. The method of claim 30, and further comprising the step of each player optionally placing a side bet on the occurrence of a) a predetermined winning hand on any hand held by any player at the table; b) a predetermined winning hand on any hand held by any player at the table that placed the side bet; or c) any hand held by any player that beats a dealer hand in rank; and paying each player at the table a bonus payout.

48. A method of playing a wagering game comprising:

a player making at least a first part wager, a second part wager and a third part wager;

a dealer dealing a partial hand of cards to each player who placed the at least a first part wager, a second part wager and a third part wager;

a dealer dealing at least one community card(s) face down on the gaming table;

each player deciding whether to withdraw the first part of the wager after viewing the partial hand;

continuing to play the game regardless of the decision on whether to withdraw the first part of the wager;

the dealer revealing at least one of the at least one community card(s);

each player deciding whether to withdraw the second part of the wager after viewing the at least one revealed community card, and wherein if said second part of the wager is withdrawn, the third part of the wager is forfeited to a house; and continuing play of the game, regardless of the decision of whether or not to withdraw the second part.

49. The method of claim 48 wherein the player makes a four-part wager, and a fourth part of the wager remains at risk during play of the game.

50. The method of claim 48 wherein the partial hand consists of three cards.

51. The method of claim 48 wherein two community cards are dealt face down.

52. The method of claim 51 wherein the dealer reveals one of the two community cards prior to each player deciding whether to withdraw the second part of the wager.

53. The method of claim 48 wherein continued play includes the dealer revealing a second community card.

54. The method of claim 48 wherein all final hands are five-card hands.

55. The method of claim 48 wherein all final hands are five-card poker hands.

56. The method of claim 48 wherein continuing play of the game includes resolving all final hands against a pay table.

57. The method of claim 48 wherein the game is resolved according to the rules of poker.

58. The method of claim 48 wherein each part of the wager is equal in value to other parts of the wager.

59. The method of claim 48 wherein the at least a first part wager, a second part wager and a third part wager also comprises a fourth part of the wager and the fourth pan of the wager must remain in play.

* * * * *